United States Patent [19]

Hallmark

[11] 4,164,886

[45] Aug. 21, 1979

[54] SEALING PROJECTILE

[75] Inventor: Bobby J. Hallmark, Fort Worth, Tex.

[73] Assignee: Gearhart-Owen Industries, Inc., Forth Worth, Tex.

[21] Appl. No.: 835,205

[22] Filed: Sep. 21, 1977

[51] Int. Cl.[2] ..... E21B 43/11

[52] U.S. Cl. ..... 89/1 C; 102/21.6; 166/55.1; 175/4.55

[58] Field of Search ..... 102/21.6, 24 HC; 175/4.55, 4.6; 166/55.1; 89/1 C

[56] References Cited

U.S. PATENT DOCUMENTS

| | | | |
|---|---|---|---|
| 3,010,396 | 11/1961 | Coleman | 175/4.55 |
| 3,246,707 | 4/1966 | Bell | 175/4.55 X |
| 3,327,792 | 6/1967 | Boop | 175/4.55 X |
| 3,441,093 | 4/1969 | Boop | 175/4.55 |
| 3,528,511 | 9/1970 | Boop et al. | 175/4.55 |
| 3,768,408 | 10/1973 | Hallmark | 102/21.6 |

*Primary Examiner*—David H. Brown

*Attorney, Agent, or Firm*—Wofford, Fails & Zobal

[57] ABSTRACT

An improved sealing projectile for use in a borehole perforating tool of a type wherein there is an explosive charge such as one or more shaped charge units disposed in each of a plurality of chambers that are located one above the other, with a partition means between each two adjacent chambers and sealingly isolating the adjacent chambers but for a passageway in the partition means through which ignition wires are passed, with a sealing projectile driven into sealing relation with the lower end portion of the passageway upon detonation of the explosive charge in the lower one of the adjacent chambers. The improved sealing projectile is provided a guide portion having a cylindrical exterior surface adapted for mating with the interior surface of said passageway and having slot means extending longitudinally of the guide portion from its outer end inwardly a distance less than the length of said guide portion but sufficient to permit an end portion of the guide portion to be disposed within said passageway while permitting ignition wires to pass from said passageway through said slot means to the lower one of said adjacent chambers, and a sealing portion merging with said guide portion.

4 Claims, 4 Drawing Figures

SEALING PROJECTILE

FIELD OF THE INVENTION

The invention relates to borehole perforating tools and more particularly to improved sealing projectiles for isolating chambers in perforating guns having a plurality of chambers each containing an explosive charge.

BACKGROUND OF THE INVENTION

It is conventional practice to make up a perforating gun having a plurality of chambers arranged one above another with each chamber containing an explosive charge, usually in the form of one or more shaped charge units. The explosive charges are commonly fired successively from bottom to top. It is necessary that the ignition of the explosive charge in one chamber will not adversely affect the ignition of those in other chambers. Consequently, it is necessary that the explosive charge of a particular chamber be effectively isolated and sealed relative to the next adjacent chamber.

Prior art practices are exemplified by my U.S. Pat. No. 3,768,408; B. J. Boop, et al, U.S. Pat. Nos. 3,528,511 and 3,528,512; and my U.S. application Ser. No. 661,796, filed Feb. 26, 1976, now U.S. Pat. 4,089,381, which is assigned to the assignee of the present invention.

In the practice ememplified by the Boop, et al, patents, adjacent chambers are isolated by a partition or sub, with ignition wires being passed through a passageway in the sub to the chamber or chambers below. Each passageway is provided a seat at its lower end portion, with a sealing projectile disposed adjacent the seat. The explosive charges in the chambers are fired successively from bottom to top. When the explosive charge of a chamber is fired, the detonating of the explosive charge drives the respective sealing projectile into its seat and the passageway to sever the ignition wires and form a seal, so that the chamber just fired is isolated both electrically and physically from the chambers above.

It has been found that sealing projectiles of the type disclosed by the Boop, et al, patents, above mentioned, are subject to significant deficiencies. The sealing projectile of the Boop, et al, patents has a conical shaped nose portion and because of the ignition wires, the sealing projectile is not driven onto its seat in a symmetrical manner, and the conical surface tends to be gouged by contact with the seat. In addition, the ignition wires tend to be subjected to a pinching or squeezing action instead of being cut cleanly, and the ignition wire severing action tends not to be completed prior to the beginning of the sealing action. As a consequence, an effective seal is not always attained.

It is, accordingly, an object of this invention to provide an improved sealing projectile that will consistently attain an effective seal.

Another object of the invention is to provide an improved sealing projectile which will be driven onto its seat in a symmetrical manner.

Another object of the invention is to provide an improved sealing projectile which will effect efficient severing of ignition wires.

Another object of the invention is to provide an improved sealing projectile such that the ignition wires will be severed prior to the beginning of the sealing action.

For a further understanding of the invention and further objectives, features, and advantages thereof, reference may now be had to the following description, taken in conjunction with the accompanying drawings.

SUMMARY OF THE INVENTION

The present invention provides an improved sealing projectile for use in a borehole perforating tool of a type wherein there is an explosive charge such as one or more shaped charge units disposed in each of a plurality of chambers that are located one above the other, with a partition means between each two adjacent chambers and sealingly isolating the adjacent chambers but for a passageway in the partition means through which ignition wires are passed, with a sealing projectile driven into sealing relation with the lower end portion of the passageway upon detonation of the explosive charge in the lower one of the adjacent chambers. The improved sealing projectile is provided a guide portion having a cylindrical exterior surface adapted for mating with the interior surface of said passageway and having slot means extending longitudinally of the guide portion from its outer end inwardly a distance less than the length of said guide portion but sufficient to permit an end portion of the guide portion to be disposed within said passageway while permitting ignition wires to pass from said passageway through said slot means to the lower one of said adjacent chambers, and a sealing portion merging with said guide portion.

Because the bottom of the slot means is spaced from the front margin of the sealing portion, the severing of the ignition wires takes place before the sealing action begins, so that the full force available is not divided, but is utilized respectively for each of the severing and the sealing operations. Because the exterior surface of the guide portion mates with the interior surface of the passageway and the ignition wires can be equally divided on the sides of the slot means, the sealing projectile is driven into the passageway in a substantially symmetrical manner with respect to the passageway longitudinal axis. It has been found that with such improved sealing projectile, an effective seal is consistently attained.

DESCRIPTION OF PREFERRED EMBODIMENT

Figure 1:
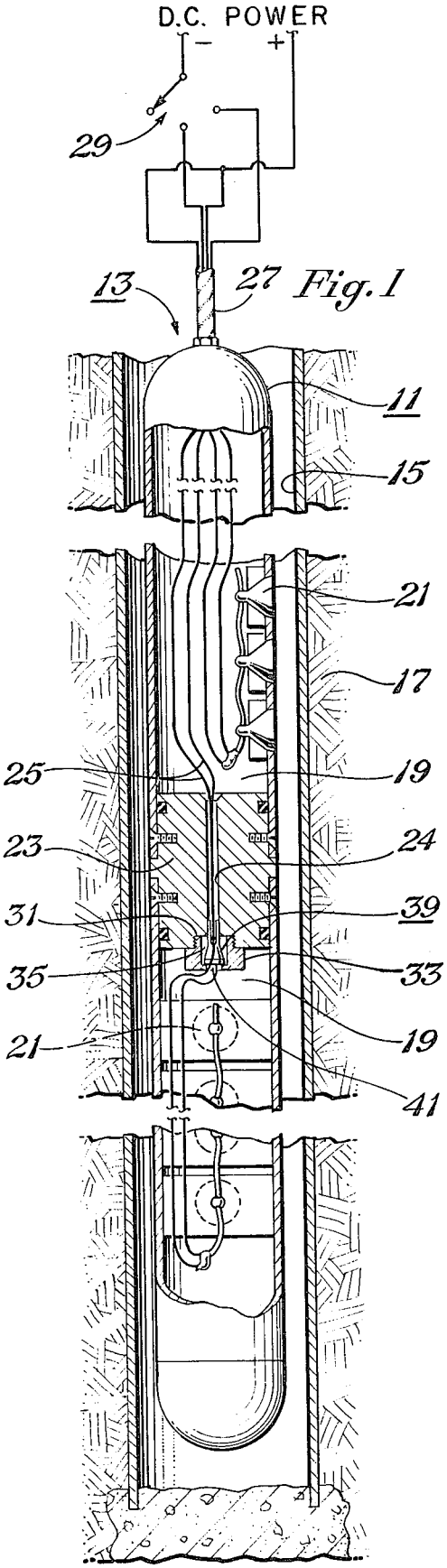
FIG. 1 is a schematic view, partly in section, showing a perforating gun utilizing the improved sealing projectile; the gun being disposed in a wellbore.

In FIG. 1 there is schematically shown a perforating gun 11 disposed in a borehole 13 within casing 15 adjacent a formation 17 to be perforated. The perforating gun 11 contains a plurality of chambers 19, with each chamber containing an explosive charge shown as shaped charge devices 21. Adjacent chambers 19 are connected by an isolating partition or sub 23 having a passageway 24 through which ignition wires 25 are passed. The perforating gun 11 is traversed into the borehole and suspended therein by means of a wireline 27 which carries suitable conductors for connection to above ground equipment, shown schematically as a firing means including a direct current power source and a switch 29. For details concerning selective firing mechanism by which explosive charges such as shaped charges or groups of shaped charges may be successively fired from bottom to top, reference is made to my U.S. Pat. No. 3,768,408.

The lower end of passageway 24 in sub 23 opens to a threaded recess 31 which receives a retainer 33. The retainer 33 is basically a threaded plug having an internal recess 35 for receiving the head portion 37 of the improved sealing projectile 39 and having a central opening 41 through which ignition wires 25 are passed. The diameter of the retainer central opening 41 is made slightly smaller than that of the sealing projectile head portion 37, so as to permit effective application of driving pressure forces while retaining the sealing projectile 39 in its proper presealing position.

The lower entry to the passageway 24 is provided a seat portion 43 against which the sealing projectile 39 is seated when driven to the sealing state. The seat portion in the embodiment shown in conveniently a 30° bevel made by a drill point.

Figure 2:
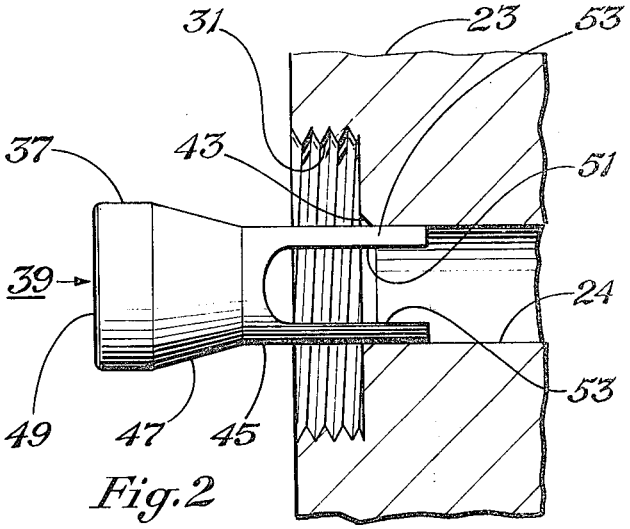
FIG. 2 is an enlarged schematic side elevational view, showing the improved sealing projectile positioned in the sub or partition passageway, without ignition wires and retainer, prior to sealing.
Figure 3:
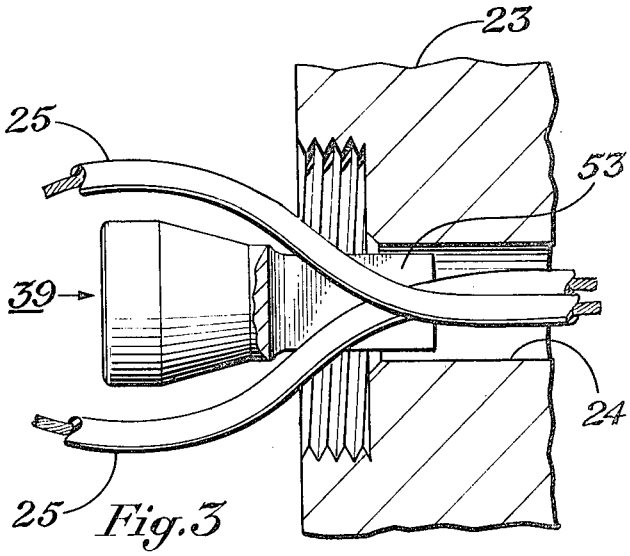
FIG. 3 is the same as FIG. 2 but with the improved sealing projectile having been rotated 90°, and with one leg of the projectile broken away for clarity, and with ignition wires in place.

In the embodiment shown, the improved sealing projectile 39, as best seen in FIGS. 2 and 3, has a guide portion 45, a sealing portion 47, and a head portion 37. The guide portion 45 has a cylindrical exterior surface and is bifurcated by a "U"-shaped slot 51 so as to form two leg portions 53. The guide portion 45 merges with the sealing portion 47 which in turn merges with the head portion 37. The sealing portion 47 is frusto-conical in shape and tapers outwardly in the direction toward the head portion 37. The taper should be great enough to ensure that the sealing projectile 39 will not be driven through the passageway 24 but small enough that the sealing projectile will be driven into the passageway to the extent necessary to provide an effective seal. In actual practice a taper of 15° has proved effective. A taper in the range of 10 to 30 degrees is thought to be satisfactory. In the embodiment shown, the head portion 37 has a cylindrical peripheral surface and a substantially planar end face 49. If desired, the head portion may be simply an extension of the sealing portion 47 taper.

In operation, the improved sealing projectile 39 is placed in its pre-sealing position adjacent to the lower end portion of the passageway 24 of a respective partition means 23 and the retainer 33 is installed in the threaded recess 31. In the pre-sealing position, the outer end portion of the guide portion 45 is inserted in the lower end of the passageway 24, with the ignition wires 25 passing from the passageway 24 through the slot 51 and through the retainer opening 41 to the lower one of the respective adjacent chambers 19. The ignition wires 25 are divided so that half exit from the passageway 24 via one side of the slot 51 and half via the other side. The pre-sealing position of the improved sealing projectile 39 is generally indicated by FIG. 3.

Figure 4:
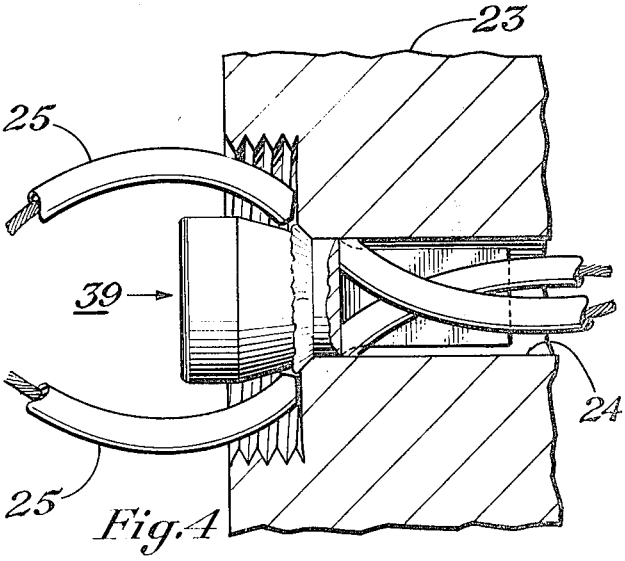
FIG. 4 is the same as FIG. 3, but after the improved sealing projectile has been driven to the sealing state and the ignition wires severed.

The fully assembled perforating gun 11 is traversed in the borehole 13 to the level of the formation to be perforated and the explosive charges 21 are ignited in succession from bottom to top as hereinabove mentioned. When the explosive charge 21 in a respective chamber 19 is ignited, the force of the detonation acts on the end face 49 of a respective improved sealing projectile 39, driving the projectile upwardly in the passageway 24. As the bottom portion of the slot 51 passes into the passageway 24, peripheral edge portions of the slot 51 cooperate with edge portions of the entrance to the passageway 24 to cleanly sever the ignition wires 25, as indicated by FIG. 4. Because the bottom of the slot 51 is spaced from the front margin of the sealing portion 47, the severing of the ignition wires 25 takes place before the sealing action begins. Because the exterior surface of guide portion 45 is cylindrical and mates with the interior surface of the passageway 24 and the ignition wires 25 were equally divided on either side of the slot 51, the improved sealing projectile is driven into the passageway 24 in a substantially symmetrical fashion with respect to the passageway longitudinal axis. As the improved sealing projectile 39 is driven further into the passageway 24, some material of the sealing portion 47 is extruded or upset so that a part of the sealing portion 47 engages the passageway interior surface in a tight interference type fit, while part of the sealing portion 47 is forced into a close fitting relation with the area closely adjacent to and surrounding the passageway entrance.

Field experience has demonstrated that the improved sealing projectile as herein shown and described will consistently attain an effective seal.

The improved sealing projectile 39 may be constructed of materials that have been conventionally utilized, preferably aluminum. Although a tapered sealing portion 47 is preferred, the combination of a taper and stepped cylindrical portions as disclosed by the Boop, et al, U.S. Pat. Nos. 3,258,511 and 3,258,512 could be used. Also, it is preferred that there be provided a seat portion 43 surrounding the lower entry to the passageway 24, but this is not essential. The retaining means can have any form that will be effective to maintain the sealing projectile in its proper pre-sealing postion while permitting passage of the detonation forces to the end face of the sealing projectile head portion.

In the preferred form, the sealing projectile slot means is a single U-shaped slot formed by milling. The slot means could, however, take other forms. For example, there could be a plurality of slots, such as two disposed 90° apart about the sealing projectile longitudinal axis. The slot means bottom portion or portions could be rectangular, V-shaped, or polygonal. Also, the slot means side walls could be curved or tapered.

The foregoing disclosure and the showings made in the drawings are merely illustrative of the principles of this invention and are not to be interpreted in a limiting sense.

What is claimed is:

1. An improved sealing projectile for use in a borehole perforating tool of a type wherein there is an explosive charge such as one or more shaped charge units disposed in each of a plurality of chambers that are located one above the other, with a partition means between each two adjacent chambers and sealingly isolating the adjacent chambers but for a passageway in the partition means through which ignition wires are passed, with a sealing projectile driven into sealing relation with the lower end portion of the passageway upon detonation of the explosive charge in the lower one of the adjacent chambers; said improved sealing projectile comprising:

a. a guide portion having a cylindrical exterior surface adapted for mating with the interior surface of said passageway and having slot means extending longitudinally of the guide portion from its outer end inwardly a distance less than the length of said guide portion but sufficient to permit an end portion of the guide portion to be disposed within said passageway while permitting ignition wires to pass from said passageway through said slot means to the lower one of said adjacent chambers, and b. a sealing portion merging with said guide portion.

2. The improved sealing projectile of claim 1 wherein said slot means is a milled U-shaped slot.

3. The improved sealing projectile of claim 1 wherein said sealing portion is frusto-conical in shape.

4. The improved sealing projectile of claim 3 wherein said sealing portion has a taper in the range of 10 to 30 degrees with respect to its longitudinal axis.

* * * * *